US007372427B2

(12) United States Patent
Leisten

(10) Patent No.: US 7,372,427 B2
(45) Date of Patent: May 13, 2008

(54) DIELECTRICALLY-LOADED ANTENNA

(75) Inventor: Oliver Paul Leisten, Kingsthorpe (GB)

(73) Assignee: Sarentel Limited (GB)

( * ) Notice: Subject to any disclaimer, the term of this patent is extended or adjusted under 35 U.S.C. 154(b) by 0 days.

(21) Appl. No.: 11/088,247

(22) Filed: Mar. 23, 2005

(65) Prior Publication Data

US 2005/0195126 A1 Sep. 8, 2005

Related U.S. Application Data

(63) Continuation-in-part of application No. 10/457,717, filed on Jun. 9, 2003, now Pat. No. 6,914,580.

(30) Foreign Application Priority Data

Mar. 21, 2005 (GB) ..... 0505771.6

(51) Int. Cl.
*H01Q 1/36* (2006.01)

(52) U.S. Cl. ..... 343/895

(58) Field of Classification Search ..... 343/895, 343/897, 904, 857, 906, 911 R, 843
See application file for complete search history.

(56) References Cited

U.S. PATENT DOCUMENTS

| | | | |
|---|---|---|---|
| 4,008,479 | A | 2/1977 | Smith |
| 4,114,164 | A | 9/1978 | Greiser |
| 5,134,422 | A | 7/1992 | Auriol |
| 5,138,331 | A | 8/1992 | Josypenko |
| 5,198,831 | A | 3/1993 | Burrell et al. |
| 5,346,300 | A | 9/1994 | Yamamoto et al. |
| 5,854,608 | A | 12/1998 | Leisten |
| 5,859,621 | A | 1/1999 | Leisten |
| 5,945,963 | A | 8/1999 | Leisten |

(Continued)

FOREIGN PATENT DOCUMENTS

| | | |
|---|---|---|
| EP | 649181 | 4/1995 |

(Continued)

OTHER PUBLICATIONS

Search Report Under Section 17(5), Patents Act of 1977, British Patent Office, issued in connection with Application No. GB 0505771.6 issued on Dec. 7, 2005.

(Continued)

*Primary Examiner*—Douglas W. Owens
*Assistant Examiner*—Minh Dieu A
(74) *Attorney, Agent, or Firm*—John Bruckner PC

(57) ABSTRACT

In a dielectrically-loaded quadrifilar antenna for operation with circularly polarised signals, four coextensive composite helical elements are plated on the outer surface of a cylindrical dielectric core, each composite element comprising two mutually adjacent conductive tracks defining between them an elongate channel or slit. The track edges bounding each channel are longer than the opposite edges of the respective tracks in that they follow parallel meandered paths, with the result that each channel deviates from a mean helical path and is longer than the corresponding portion of the mean helical path. At a frequency within the operating band of the antenna, the channels have respective electrical lengths equivalent to a half wavelength. The bandwidth of the antenna is greater than the bandwidth of a correspondingly dimensioned antenna having single-track helical elements.

41 Claims, 7 Drawing Sheets

U.S. PATENT DOCUMENTS

| | | | | |
|---|---|---|---|---|
| 5,963,180 | A | 10/1999 | Leisten | |
| 6,088,000 | A | 7/2000 | Ho | |
| 6,094,178 | A | 7/2000 | Sanford | |
| 6,181,297 | B1 | 1/2001 | Leisten | |
| 6,184,845 | B1 | 2/2001 | Leisten et al. | |
| 6,229,499 | B1 | 5/2001 | Licul et al. | |
| 6,288,686 | B1 * | 9/2001 | Josypenko | 343/895 |
| 6,300,917 | B1 | 10/2001 | Leisten et al. | |
| 6,421,028 | B1 | 7/2002 | Ohgren et al. | |
| 6,433,755 | B1 * | 8/2002 | Kuramoto | 343/895 |
| 6,480,173 | B1 * | 11/2002 | Marino | 343/895 |
| 6,587,081 | B2 * | 7/2003 | Noro et al. | 343/895 |
| 6,653,987 | B1 * | 11/2003 | Lamensdorf et al. | 343/895 |
| 6,765,541 | B1 * | 7/2004 | Josypenko | 343/895 |
| 6,765,542 | B2 * | 7/2004 | McCarthy et al. | 343/895 |
| 2001/0045916 | A1 | 11/2001 | Noro et al. | |

FOREIGN PATENT DOCUMENTS

| | | |
|---|---|---|
| EP | 0666613 | 8/1995 |
| EP | 0 757 406 A1 | 2/1997 |
| EP | 0856906 | 8/1998 |
| EP | 0917241 | 5/1999 |
| FR | 2746547 | 9/1997 |
| FR | 2814286 | 3/2002 |
| GB | 2292638 | 2/1996 |
| GB | 2321785 | 8/1998 |
| GB | 2345789 | 7/2000 |
| GB | 2345798 | 7/2000 |
| GB | 2351850 | 1/2001 |
| GB | 239948 | 9/2004 |
| JP | 2000036707 | 2/2000 |
| WO | WO 98/28817 | 7/1998 |
| WO | WO 99/60665 | 11/1999 |

OTHER PUBLICATIONS

Search Report Under Section 17(5), Patents Act of 1977, British Patent Office, issued in connection with Application No. GB 0307251.9 issued on Jul. 18, 2003.

International Search Report, European Patent Office, mailed in connection with PCT/GB2004/001109 on Jul. 5, 2004.

Search Report Under Section 17(5), Patents Act of 1977, British Patent Office, issued in connection with Application No. GB 0505771.6 issued on Jun. 15, 2005.

International Search Report issued in connection with PCT/GB2006/000947 and mailed on May 24, 2006.

* cited by examiner

DIELECTRICALLY-LOADED ANTENNA

CROSS-REFERENCES TO RELATED APPLICATION

This application is a continuation-in-part of, and claims a benefit of priority under 35 U.S.C. 120 from, U.S. application Ser. No. 10/457,717 filed by the present applicant on Jun. 9, 2003 now U.S. Pat. No. 6,914,580, the entire contents of which are hereby expressly incorporated herein by reference for all purposes. U.S. application Ser. No. 10/457,717 in-turn claims a benefit of priority under one or more of 35 U.S.C. 119(a)-119(d) from British Patent Application No. 0307251.9, filed Mar. 28, 2003, the entire contents of which are hereby expressly incorporated herein by reference for all purposes. This application claims a benefit of priority under one or more of 35 U.S.C. 119(a)-119(d) from British Patent Application No. 0505771.6, filed Mar. 21, 2005, the entire contents of which are hereby expressly incorporated herein by reference for all purposes.

FIELD OF THE INVENTION

This invention relates to a dielectrically-loaded antenna for operation at frequencies in excess of 200 MHz. The invention is applicable primarily but not exclusively to a quadrifilar helical antenna for operation with circularly polarised electromagnetic radiation and to a loop antenna having a plurality of resonant frequencies within a band of operation.

BACKGROUND OF THE INVENTION

A dielectrically-loaded loop antenna is disclosed in British Patent Application No. 2309592A. Whilst this antenna has advantageous properties in terms of isolation from the structure on which it is mounted, its radiation pattern, and specific absorption ratio (SAR) performance when used on, for instance, a mobile telephone close to the user's head, it suffers from the generic problem of small antennas in that it has insufficient bandwidth for many applications. Improved bandwidth can be achieved by splitting the radiating elements of the antenna into portions having different electrical lengths. For example, as disclosed in British Patent Application No. 2321785A, the individual helical radiating elements can each be replaced by a pair of mutually adjacent, substantially parallel, radiating elements connected at different positions to a linking conductor linking opposed radiating elements. In another variation, disclosed in British Patent Application No. 2351850A, the single helical elements are replaced by laterally opposed groups of elements, each group having a pair of coextensive mutually adjacent radiating elements in the form of parallel tracks having different widths to yield differing electrical lengths. These variations on the theme of a dielectrically-loaded twisted loop antenna gain advantages in terms of bandwidth by virtue of their different coupled modes of resonance which occur at different frequencies within a required band of operation.

Dielectrically-loaded quadrifilar helical antennas are disclosed in British Patents Nos. 2292638, 2310543 and 2367429. Antennas in accordance with these patents have been used mainly for receiving circularly polarised signals from satellites of the Global Positioning System (GPS) satellite constellation for position fixing and navigation purposes. GPS is a narrowband service. There are other satellite-based services requiring receiving or transmitting apparatus of greater fractional bandwidth than that available from the prior antennas.

It is an object of the invention to provide improvements in bandwidth.

SUMMARY OF THE INVENTION

According to one aspect of the present invention, there is provided a dielectrically-loaded antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a plurality of laterally opposed groups of conductive elongate elements, said groups being spaced apart on said core outer surface and each group comprising first and second substantially coextensive elongate elements which are coupled together at respective first ends at a location in the region of the feed connection and at respective second ends at a location spaced from the feed connection, wherein the antenna element structure further comprises a linking conductor linking the second ends of the first and second elongate elements of each of the plurality of groups of elements with the second ends of the first and second elements of the other of said plurality of groups of elements, whereby the first and second elements respectively of each of said plurality of groups form parts of different looped conductive paths, said paths having different respective resonant frequencies within an operating frequency band of the antenna and each extending from the feed connection to the linking conductor, and then back to the feed connection, and wherein at least one of the said elongate antenna elements comprises a conductive strip on the outer surface of the core, the strip having opposing edges of different lengths.

The differing lengths of the opposing edges may be brought about by the edges being non-parallel.

In one embodiment of the invention, the edge of the strip which is furthest from the other elongate element or elements in its group is longer than the edge which is nearer the other element or elements. Indeed, both the first and second elongate elements of each group may have edges of different lengths, e.g., in that each such element which has an edge forming an outermost edge of the group is configured such that the outermost edge is longer than the inner edge of the element.

Alternatively, that edge of the strip which is nearest to the other elongate element or elements in its group may be longer than the edge which is further from the other elongate element or elements of the group.

Such differences in edge length may be obtained by forming each affected element so that one of its edges follows a wavy or meandered path along substantially the whole of its radiating length. Thus, in the case of an antenna with helical elements, with each group of elements executing, e.g., a half turn around the central axis of a cylindrical dielectric core, the helical portion of each element has one edge which follows a strict helical path, whilst the other edge follows a path which deviates from the strict helical path in a sinusoid, castellated or smooth pattern, for example.

Advantageously, where both outermost edges of each group of elements follow a path which varies from the strict helix, the variations are equal for both edges at any given position along the length of the group of elements so that the overall width of the group at any given position is substantially the same. Indeed, the outermost edges may be formed so as to be parallel along at least a major part of the length of the group of elements.

Such structures take advantage of the discovery by the applicant that grouped and substantially coextensive radiating elements of different electrical lengths have fundamental modes of resonance corresponding not only to the individual elements which are close together, but also corresponding to the elements as a combination. Accordingly, where each group of elements has two substantially coextensive mutually adjacent elongate radiating elements, there exists a fundamental mode of resonance associated with one of the tracks, another fundamental resonance associated with the other of the tracks, and a third fundamental resonance associated with the composite element represented by the two tracks together. The frequency of the third resonance can be manipulated by asymmetrically altering the lengths of edges of the elements. In particular, by lengthening the outer edges of the two elements of each group, the frequency of the third resonance can be altered differently, and to a greater degree, than the resonant frequencies associated with the individual tracks. It will be appreciated, therefore, that, the third frequency of resonance can be brought close to the other resonant frequencies so that all three couple together to form a wider band of reduced insertion loss than can be achieved with the above-described prior art antennas, at least for a given resonance type (i.e., in this case, the balanced modes of resonance in the preferred antenna).

An antenna as described above, having groups of laterally opposed elongate antenna elements with each group having two mutually adjacent such elements, is one preferred embodiment of the invention. In that case, the elongate elements of each pair have different electrical lengths and define between them a parallel sided channel, each element having a meandered outer edge.

In an alternative embodiment, each group of elongate antenna elements has three elongate elements, arranged side-by-side. In this case, each group comprises an inner element and two outer elements. Preferably, the outwardly directed edges of the two outer elements of each group are meandered or otherwise caused to deviate from a path parallel to the corresponding inner edges, and the inner element is parallel-sided. More preferably, at least one of the outer elements of each group has a deviating outer edge and a deviating inner edge, the amplitude of the outer edge deviation being greater than the amplitude of the inner edge deviation.

Using groups of two elements with non-parallel edges it is possible to achieve a fractional bandwidth in excess of 3% at an insertion loss of −6 dB. Embodiments with three or more elements per group offer further bandwidth gains, in terms of fractional bandwidth and/or insertion loss.

According to another aspect of the invention, a dielectrically-loaded antenna for operation at frequencies in excess of 200 MHz comprises an electrically insulative core of a solid dielectric material having a relative dielectric constant greater than 5, a feed connection, and an antenna element structure disposed on or adjacent the outer surface of the core, wherein the core has end surfaces and side surfaces and an axis of symmetry passing through the end surfaces, and wherein the antenna element structure comprises a plurality of groups of elongate antenna elements spaced apart on said side surfaces of the core, each group forming part of a plurality of looped conductive paths which extend from a first to a second terminal of the feed connection and which have different electrical lengths at a frequency within an operating band of the antenna, and each group comprising first and second substantially coextensive elongate radiating elements which run side-by-side on or adjacent the side surfaces of the core and which form part of a different respective one of said looped paths of different electrical lengths, wherein at least one of the said elongate elements on or adjacent the side surfaces comprises a conductive strip having non-parallel opposing edges such that the opposing edges of strip are of different lengths.

Typically the feed connection is located on one of the end surfaces of the core and the said elongate elements of the group are connected to the feed connection by a plurality of connecting elements on or adjacent the said end surface. Preferably, the strip has non-parallel edges over at least the major part of its length on the respective side surface or surfaces of the core.

According to a third aspect of the invention, there is provided a dielectrically-loaded antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a plurality of groups of conductive elongate elements, each group comprising first and second substantially coextensive mutually adjacent elongate elements at least one of which comprises a conductive strip on the outer surface of the core, the strip having opposing edges of different lengths. Advantageously, the core is cylindrical and has a central axis and the feed connection comprises a feeder termination on an end face of the core. The antenna element structure may include a linking conductor in the form of an annular sleeve encircling the core and centred on the axis, the sleeve interconnecting conductive tracks of the element groups at a sleeve rim, the sleeve also being connected to the feeder structure at a position spaced from the feed connection.

It is preferred that the first and second coextensive elongate elements comprise, respectively, first and second coextensive conductive tracks defining between them a channel the width of which is less than the spacing between the tracks of the respective said groups and the tracks of neighbouring groups, and wherein the electrical length of the channel is substantially a half wavelength in an operative frequency band of the antenna.

According to a fourth aspect of the invention, there is provided a quadrifilar helical antenna comprising first and second pairs of diametrically opposed antenna elements on a generally cylindrical dielectric substrate, at least one of the elements of each pair including a pair of mutually adjacent substantially parallel conductive tracks defining between them a channel, the track edges which define the channel being longer than the other edges of the respective tracks.

The preferred quadrifilar antenna takes the form of a backfire antenna having an axial feeder structure located in a bore in a solid dielectric antenna core made of a material having a relative dielectric constant greater than 5. There are four radiating composite elements each extending from a feed connection where the feeder structure terminates at a distal end face of the core, to a linking conductor which interconnects the four composite elements at a location which is axially spaced from the feed connection. The linking conductor is connected to the feeder structure proximally with respect to the feed connection.

In this preferred quadrifilar antenna, the composite elements forming the first pair of diametrically opposed antenna elements have a shorter average electrical length than those forming the second pair to yield substantial phase orthogonality between currents in the respective elements of the first and second pairs. As in conventional quadrifilar antennas, this phase orthogonality produces an operating band in which the antenna exhibits increased gain for circularly polarised signals.

In the preferred embodiment, each composite radiating element has a first, radial portion on the distal end face of the core and a second, helical portion extending from the first portion to the linking conductor. Each of the four composite elements includes a pair of mutually adjacent parallel tracks defining the above-mentioned channel between them. Advantageously, each element is divided in this way only in its second, helical portion, the track edges defining the channel following, e.g., generally parallel meandered paths to increase the length of the channel within the available length of the radiating element. In this way, the electrical length of the channel can be increased to a half wavelength at an operating frequency of the antenna despite the fact that, in the preferred embodiment, the helical portion of each antenna element has an electrical length which is less than a half wavelength. Differences between the lengths of the conductive paths of which the tracks form parts, as well as dissociation of the currents in the tracks in each respective antenna element as a result of the half wavelength electrical length of the channel between them, promote a resonance for axially directed circularly-polarised radiation which has a greater bandwidth than that achievable with an equivalently-sized antenna having single track radiating elements. The bandwidth depends on, amongst other factors, the degree of dissociation between the currents in the respective composite elements each comprising parallel conductor tracks separated by a channel or slit. Current dissociation produces a phase dwell in the operating band in the sense that phase orthogonality between the average of the currents in each longer composite element is extended over a wider frequency band than in conventional quadrifilar antennas. Substantial phase orthogonality can typically be achieved over a fractional bandwidth of at least 0.4%. In some embodiments the fractional bandwidth may be 2% or more. Substantial phase orthogonality may be defined as exhibiting a phase difference of between 60° and 120°.

It is not necessary for the physical angular separation between the diametrically opposed pairs of shorter and longer composite elements to be exactly 90°, i.e. subtended at the axis of the helices. For example, the angular separation may be 70° or 80°. It is preferred that, in the operating band of the antenna, the phase difference between the average of currents in the shorter pair and the average of currents in the longer pair be within 30° of this angular separation or, better, within 20°. The operating band has the same fractional bandwidth limits referred to above. Thus, for instance, if the physical angular separation is 80°, the phase difference is preferably within the range of from 60 to 100° over the whole of a fractional bandwidth of at least 0.4%, or at least 2%.

By confining the channel to the helical portion of each antenna element, the radial portion on the distal end face of the core is made available for tuning by adjustments, i.e. removing conductive material from the antenna element, e.g., by forming cut-outs or apertures using laser etching, as disclosed in British Patent No. 2356086, the entire contents of which are incorporated in the present specification by reference.

In common with the antenna disclosed in the above-mentioned British Patents Nos. 2292638 and 2310543, the linking conductor of the preferred antenna comprises a conductive sleeve encircling the core and connected to the feeder structure. Each antenna element is joined to the rim of the sleeve with the channel preferably also extending to the level of the rim or very close to the level of the rim.

The mutually adjacent tracks of each antenna element may have different electrical lengths by, for example, having different average widths. Alternatively, differences in conductive path length may be achieved as a result of the inherent inclination of the tracks with respect to the rim and the consequent differences in the current patterns at their respective junctions with the rim.

According to a fifth aspect of the invention, a helical antenna for circularly polarised electromagnetic radiation comprises: first and second pairs of helical conductive track groups on or adjacent the outer generally cylindrical surface of a generally cylindrical insulative substrate, the track groups being distributed around the said outer surface and each comprising at least a pair of generally helical tracks which each have one edge longer than the other and each of which is nearer to the other track of the said pair that it is to the tracks of the other groups. The tracks of each group preferably define between themselves a substantially parallel-sided elongate channel of an average width which is less than half of the average spacing between neighbouring track groups.

According to a sixth aspect of the invention, there is provided a quadrifilar helical antenna for operation in a frequency band above 200 MHz, wherein the antenna comprises four coextensive composite helical antenna elements each of which is formed as the combination of at least two coextensive elongate conductors separated by a slit, the width of the slit being less than half of the spacing between the respective composite element and either of the neighbouring composite elements.

Loop antennas as described above and having a single pair of diametrically opposed groups of conductive elements are of particular application in the frequency division duplex portion of the IMT-2000 3-G receive and transmit bands (2110-2170 MHz and 1920-1980 MHz). They can also be applied to other mobile communication bands such as the GSM-1800 band (1710-1880 MHz), the PCS1900 band (1850-1990 MHz) and the Bluetooth LAN band (2401-2480 MHz).

Quadrifilar antennas in accordance with the invention have particular use with the following bands of operation:

(a) 1559-1591 MHz (Galileo satellite positioning system)
(b) 1260-1300 MHz (Galileo satellite positioning system)
(c) 1164-1214 MHz (Galileo satellite positioning system)
(d) 1563-1587 MHZ (GPS L1)
(e) 1216-1240 MHz (GPS L2)
(f) 1164-1188 MHZ (GPS L5)
(g) 1602.56-1615.50 MHz (Glonass)
(h) 1240-1260 MHZ (Glonass)
(i) 1610.0-1626.5 (Iridium satellite communications)
(j) 2332.5-2345.0 MHz (XM satellite radio)
(k) 2320.0-2332.5 MHz (Sirius satellite radio)

The services associated with these bands are indicated above in brackets.

The invention will be described below in more detail with reference to the drawings.

DETAILED DESCRIPTION OF THE PREFERRED EMBODIMENTS

Figure 1:
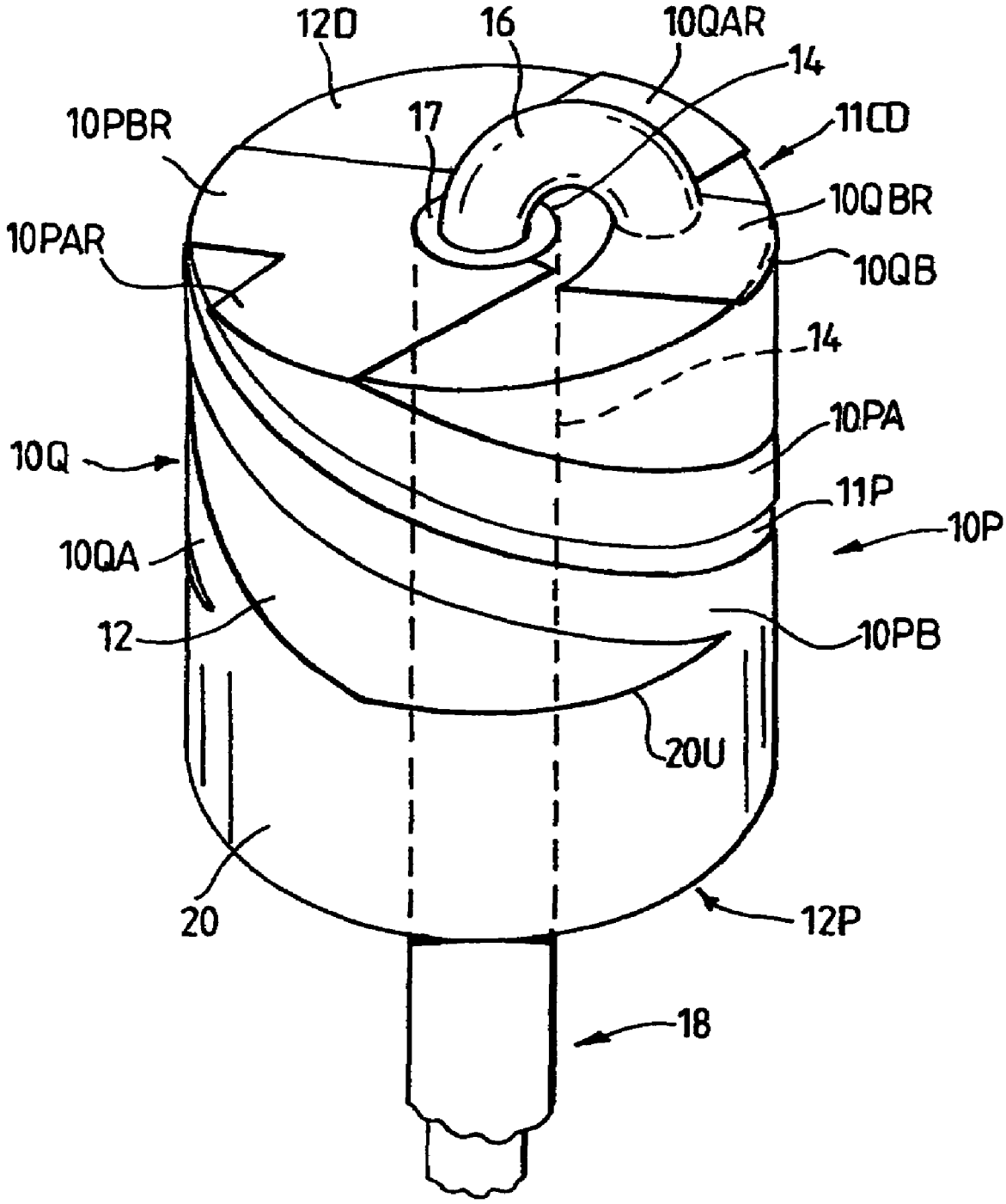
FIG. 1 is a perspective view of a dielectrically-loaded loop antenna having two laterally opposed groups of helical radiating elongate elements.

Referring to FIG. 1, a twisted loop antenna of a construction similar to that shown in British Patent Application No. 2351850A has an antenna element structure comprising a pair of laterally opposed groups 10P, 10Q of elongate radiating antenna elements. The term "radiating" is used in this specification to describe antenna elements which, when the antenna is connected to a source of radio frequency energy, radiate energy into the space around the antenna. It will be understood that, in the context of an antenna for receiving radio frequency signals, the term "radiating elements" refers to elements which couple energy from the space surrounding the antenna to the conductors of the antenna for feeding to a receiver.

Each group 10P, 10Q of elements comprises, in this embodiment, two coextensive, mutually adjacent and generally parallel elongate antenna elements 10PA, 10PB; 10QA, 10QB which are disposed on the outer cylindrical surface of an antenna core 12 made of a ceramic dielectric material having an relative dielectric constant greater than 5, typically 36 or higher. The core 12 has an axial passage 14 with an inner metallic lining, the passage 14 housing an axial inner feeder conductor 16 surrounded by a dielectric insulating sheath 17. The inner conductor 16 and the lining together form a coaxial feeder structure which passes axially through the core 12 from a distal end face 12D of the core to emerge as a coaxial transmission line 18 from a proximal end face 12P of the core 12. The antenna element structure includes corresponding radial elements 10PAR, 10PBR, 10QAR, 10QBR formed as conductive tracks on the distal end face 12D connecting distal ends of the elements 10PA, 10PB, 10QA, 10QB to the feeder structure. The elongate radiating elements 10PA to 10QB, including their corresponding radial portions, are of approximately the same physical length, and each includes a helical conductive track executing a half turn around the axis of the core 12. Each group of elements comprises a first element 10PA, 10QA of one width and a second element 10PB, 10QB of a different width. These differences in width cause differences in electrical lengths, due to the differences in wave velocity along the elements.

To form complete conductive loops, each antenna element 10PA, 10PB, 10QA, 10QB is connected to the rim 20U of a common virtual ground conductor in the form of a conductive sleeve 20 surrounding a proximal end portion of the core 12 as a link conductor for the elements 10PA, 10PB, 10QA, 10QB. The sleeve 20 is, in turn, connected to the lining of the axial passage 14 by conductive plating on the proximal end face 12D of the core 12. Thus, a first 360 degrees conductive loop is formed by elements 10PAR, 10PA, rim 20U, and elements 10QA and 10QAR, and a second 360 degree conductive loop is formed by elements 10PBR, 10PB, the rim 20U, and elements 10QB and 10QBR. Each loop extends from one conductor of the feeder structure around the core to the other conductor of the feeder structure. The resonant frequency if one loop is slightly different from that of the other.

At any given transverse cross-section through the antenna, the first and second antenna elements of the first group 10P are substantially diametrically opposed to the corresponding first and second elements, respectively, of the second group 10Q. It will be noted that, owing to each helical portion representing a half turn around the axis of the core 12, the first ends of the helical portions of each conductive loop are approximately in the same plane as their second ends, the plane being a plane including the axis of the core 12. Additionally it should be noted that the circumferential spacing, i.e. the spacing around the core, between the neighbouring elements of each group is less than that between the groups. Thus, elements 10PA and 10PB are closer to each other than they are to the elements 10QA, 10QB.

The conductive sleeve 20 covers a proximal portion of the antenna core 12, surrounding the feeder structure, the material of the core filing substantially the whole of the space between the sleeve 20 and the metallic lining of the axial passage 14. The combination of the sleeve 20 and plating forms a balun so that signals in the transmission line formed by the feeder structure 18 are converted between an unbalanced state at the proximal end of the antenna and a balanced state at an axial position above the plane of the upper edge 20U of the sleeve 20. To achieve this effect, the axial length of the sleeve is such that, in the presence of an underlying core material of relatively high dielectric constant, the balun has an electrical length of about $\lambda/4$ or 90° in the operating frequency band of the antenna. Since the core material of the antenna has a foreshortening effect, the annular space surrounding the inner conductor is filled with an insulating dielectric material having a relatively small dielectric constant, the feeder structure 18 distally of the sleeve has a short electrical length. As a result, signals at the distal end of the feeder structure 18 are at least approximately balanced. A further effect of the sleeve 20 is that for frequencies in the region of the operating frequency of the antenna, the rim 20U of the sleeve 20 is effectively isolated from the ground represented by the outer conductor of the feeder structure. This means that currents circulating between the antenna elements 10PA, 10PB, 10QA, 10QB are confined substantially to the rim part. The sleeve thus acts as an isolating trap when the antenna is resonant in a balanced mode.

Since the first and second antenna elements of each group 10P, 10Q are formed having different electrical lengths at a given frequency, the conductive loops formed by the elements also have different electrical lengths. As a result, the antenna resonates at two different resonant frequencies, the actual frequencies depending, in this case, on the widths of the elements. As FIG. 1 shows, the generally parallel elements of each group extend from the region of the feed connection on the distal end face of the core to the rim 20U of the balun sleeve 20, thus defining an inter-element channel or slit 11P, 11Q (FIG. 13) between the elements of each group.

The length of the channels are arranged to achieve substantial isolation of the conductive paths from one another at their respective resonant frequencies. This is achieved by forming the channels with an electrical length of $\lambda/2$, or $n\lambda/2$ where n is an odd integer. In effect, therefore, the electrical lengths of each of those edges of the conductors 10PA, 10PB, 10QA, 10QB bounding the channels 11P, 11Q are also $\lambda/2$ or $n\lambda/2$. At a resonant frequency of one of the conductive loops, a standing wave is set up over the entire length of the resonant loop, with equal values of voltage being present at locations adjacent the ends of each $\lambda/2$ channel, i.e. in the regions of the ends of the antenna elements. When one of the loops is resonating, the antenna elements which form part of the non-resonating loop are isolated from the adjacent resonating elements, since equal voltages at either ends of the non-resonant elements result in zero current flow. When the other conductive path is resonant, the other loop is likewise isolated from the resonating loop. To summarise, at the resonant frequency of one of the conductive paths, excitation occurs in that path simultaneously with isolation from the other path. It follows that at least two quite distinct resonances are achieved at different frequencies due to the fact that each branch loads the conductive path of the other only minimally when the other is at resonance. In effect, two or more mutually isolated low impedance paths are formed around the core.

The channels 11P, 11Q are located in the main between the antenna elements 10PA, 10PB, 10QA, 10QB respectively, and extend by a relatively small distance into the sleeve 20. Typically, for each channel, the length of the channel part is located between the elements would be no less than 0.7 L, where L is the total physical length of the channel.

Other features of the antenna of FIG. 1 are described in the above-mentioned British Patent Applications Nos. 2351850A and 2309592A, the disclosures of which are incorporated in this application by reference.

Figure 2:
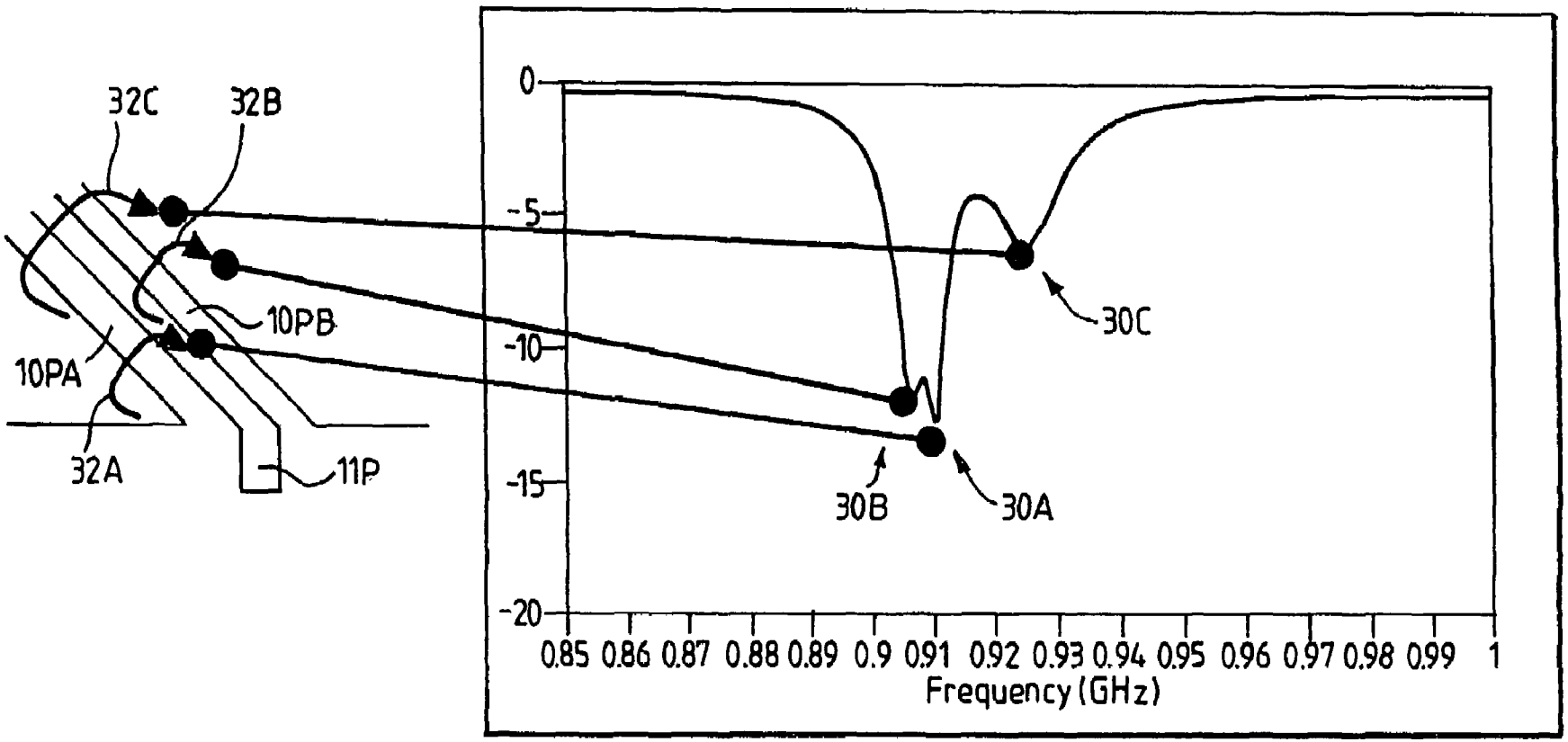
FIG. 2 is a diagram illustrating three fundamental resonances obtained from the antenna of FIG. 1, and an indication of their derivation.

The applicant has discovered that the antenna of FIG. 1 exhibits three fundamental balanced mode resonances. Referring to FIG. 2, which includes a graph plotting insertion loss (S11) with frequency and also shows a portion of one of the groups of antenna elements 10PA, 10PB where they meet the rim 20U of the sleeve 20 (see FIG. 1), each individual element 10PA, 10PB gives rise to a respective resonance 30A, 30B. The electrical lengths of the elements are such that these resonances are close together and are coupled. Each of these resonances has an associated current in the respective radiating element 10PA, 10PB which, in turn, induces a respective magnetic field 32A, 32B around the element 10PA, 10PB and passing through the slit 11P, as shown in FIG. 2. The applicants have discovered that there exists a third mode of resonance, which is also a balanced mode resonance, with an associated current which is common to both elements 10PA, 10PB and which has an associated induced magnetic field 32C that encircles the group 10P of elements 10PA, 10PB without passing through the channel or slit 11P between the two elements 10PA, 10PB.

The coupling between the resonances 30A, 30B due to the individual tracks can be adjusted by adjusting the length of the channel 11P which isolates the two tracks from each other. In general, this involves forming the channel so that it passes a short distance into the sleeve 20. This yields circumstances that permit each helical element 10PA, 10PB to behave as a half wave resonant line, current fed at the distal end face of the core 12 (FIG. 1) and short circuited at the other end, i.e., the end where it meets the rim 20U of the sleeve 20, such that either (a) resonant currents can exist on any one element or (b) no currents exist due to the absence of drive conditions.

As explained above, the frequencies of the resonances associated with the individual elements 10PA, 10PB are determined by the respective track widths which, in turn, set the wave velocities of the signals that they carry.

The applicant has found that it is possible to vary the frequency of the third resonance 30C differently from the frequencies of the individual element resonances 30A, 30B.

Figure 3A:
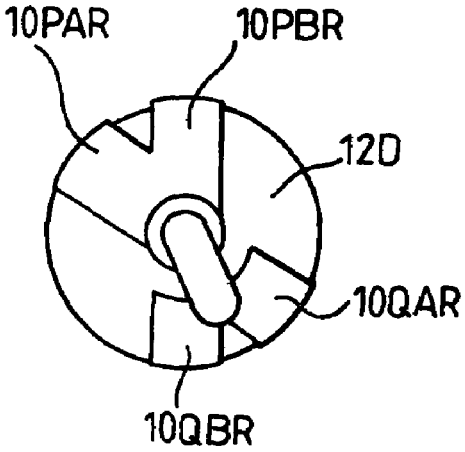
FIGS. 3A, 3B and 3C are respectively a plan view of an antenna in accordance with the invention, a side view of such an antenna, and a "mask" view of the cylindrical surface of the antenna transformed to a plane.
Figure 3B:
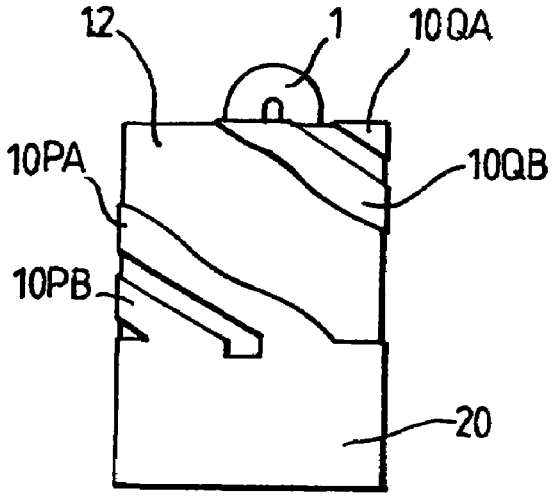
Figure 3C:
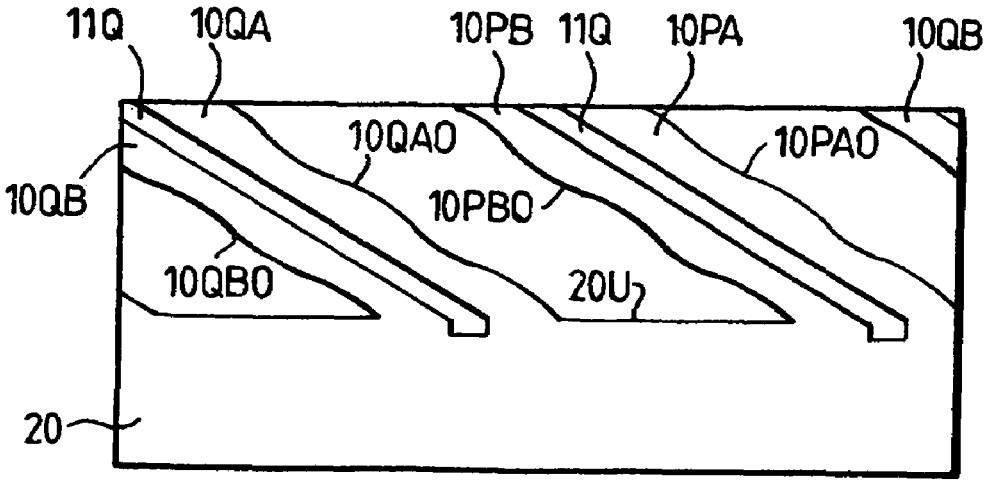

In the preferred loop antenna of the present invention, this is done by forming the helical elements 10PA, 10PB, 10QA, 10QB such that their outermost edges are meandered with respect to their respective helical paths, as shown in FIGS. 3A to 3C. As will be seen from FIG. 3C, the outwardly directed edge 10PAO, 10PBO, 10QO, 10QO of each helical element 10PA, 10PB, 10QA, 10QB deviates from the helical path in a sinusoidal manner along the whole of its length. The inner edges of the elements 10PA, 10PB, 10QA, 10QB are, in this embodiment, strictly helical and parallel to each other on opposite sides of the respective channel 11P, 11Q. The sinusoidal paths of the outermost edges of the elements of each group are also parallel. This is because at any given point along the elements 10PA, 10PB or 10QA, 10QB of a group, the deviations of the respective outermost edges are in the same direction. The deviations also have the same pitch and the same amplitude.

The effect of the meandering of the outermost edges of the elements 10PA, 10PB, 10QA, 10QB is to shift the natural frequency of the common-current mode down to a frequency which depends on the amplitude of the meandering. In effect, the common-current resonant mode which produces resonance 30C (FIG. 2) has its highest current density at the outermost edges 10PAO to 10QBO, and altering the amplitude of the meandering tunes the frequency of the resonance 30C at a faster rate than the frequencies of the individual elements (i.e. the resonances 30A, 30B in FIG. 2). This is because, as will be seen from FIG. 2, when compared with FIG. 3C, the currents associated with the common-current mode, producing resonance 30C, are guided along two meandering edges 10PAO, 10PBO; 10QAO, 10QBO, rather than along one meandered edge and one straight edge as in the case of the individual elements 10PA, 10PB, 10QA, 10QB.

Figure 4:
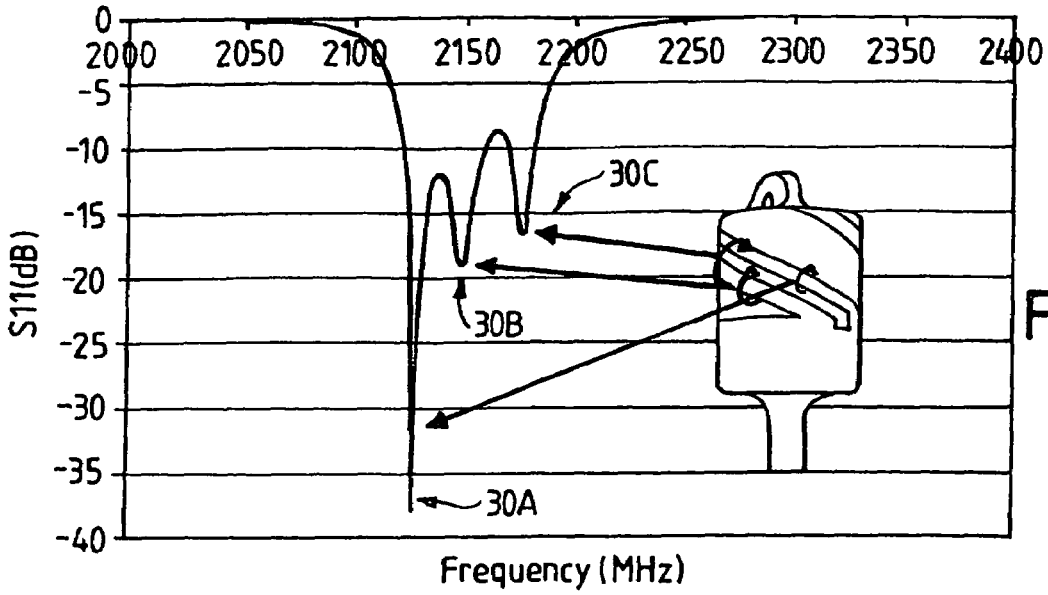
FIG. 4 is a diagram similar to that of FIG. 2, showing resonances obtained with the antenna of FIGS. 3A to 3C, together with an indication of their derivation.

This variation in the length of the outermost edges of the elements 10PA, 10PB, 10QA, 10QB can be used to shift the third resonance 30C closer to the resonances 30A and 30B, as shown in FIG. 4, to produce an advantageous insertion loss characteristic covering a band of frequencies. In the particular example shown in FIG. 6, the antenna has an operating band coincident with the IMT-2000 3-G receive band of 2110 to 2170 MHz, and a fractional bandwidth approaching 3% at −9 dB has been achieved.

Figure 5A:
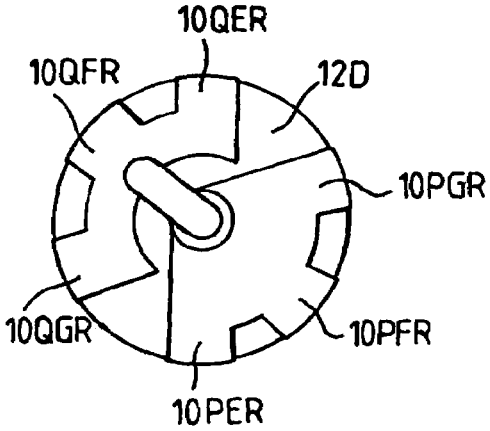
FIGS. 5A to 5C are, respectively, plan, side, and "mask" views of a second antenna in accordance with the invention.
Figure 5B:
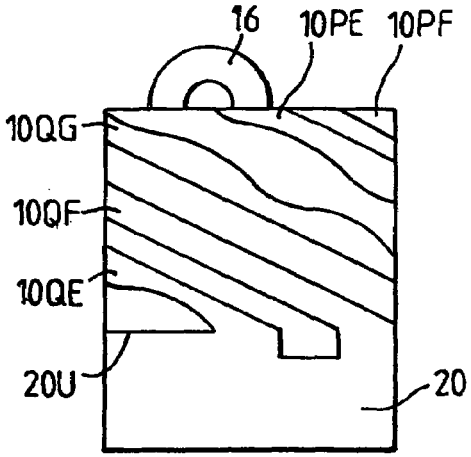
Figure 5C:
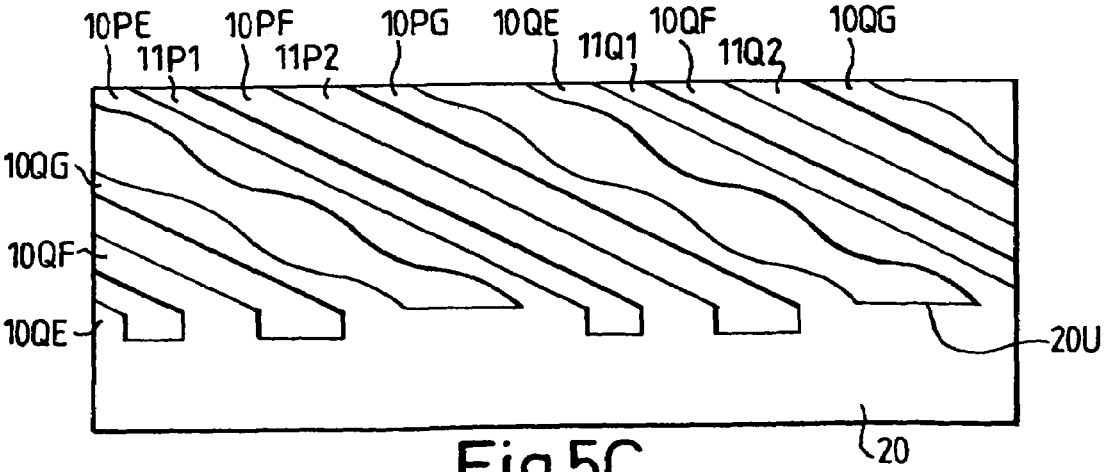

In an alternative embodiment of the invention, each group of antenna elements may comprise three elongate elements 10PE, 10PF, 10PG, 10QE, 10QF and 10QG, as shown in FIGS. 5A to 5C, which are views corresponding to the views of FIGS. 3A to 3C in respective of the first embodiment.

As before, each element has a corresponding radial portion 10PER to 10QGR connecting to the feeder structure, and each element is terminated at the rim 20U of the sleeve 20. The elements within each group 10PE, 10PF, 10PG, 10QE, 10QF, 10QG are separated from each other by half wave channels 11P1, 11P2; 11Q1, 11Q2 which, as in the first embodiment, extend from the distal face 12D of the core into the sleeve 20, as shown.

In addition, as in the embodiment of FIGS. 3A to 3C, the elements in each group are of different average widths, each element within each group having an element of a corresponding width in the other group, elements of equal average width being diametrically opposed across the core on opposite sides of the core axis. In this case, the narrowest elements are elements 10PE and 10QE. The next wider elements are those labelled 10PG and 10QG, and the widest elements are the elements in the middle of their respective groups, elements 10PF and 10QF.

Figure 6:
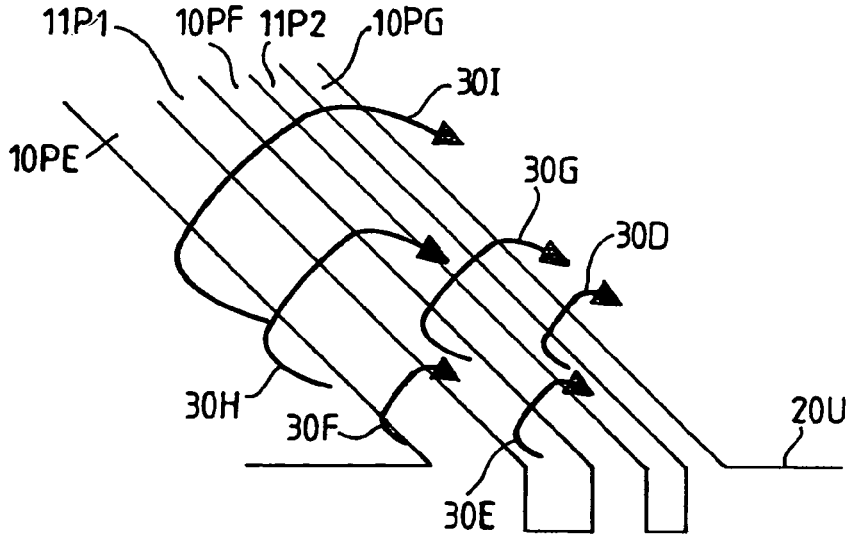
FIG. 6 is another diagram similar to part of FIG. 2 showing the derivation of resonances of the antenna of FIGS. 5A to 5C.
Figure 7:
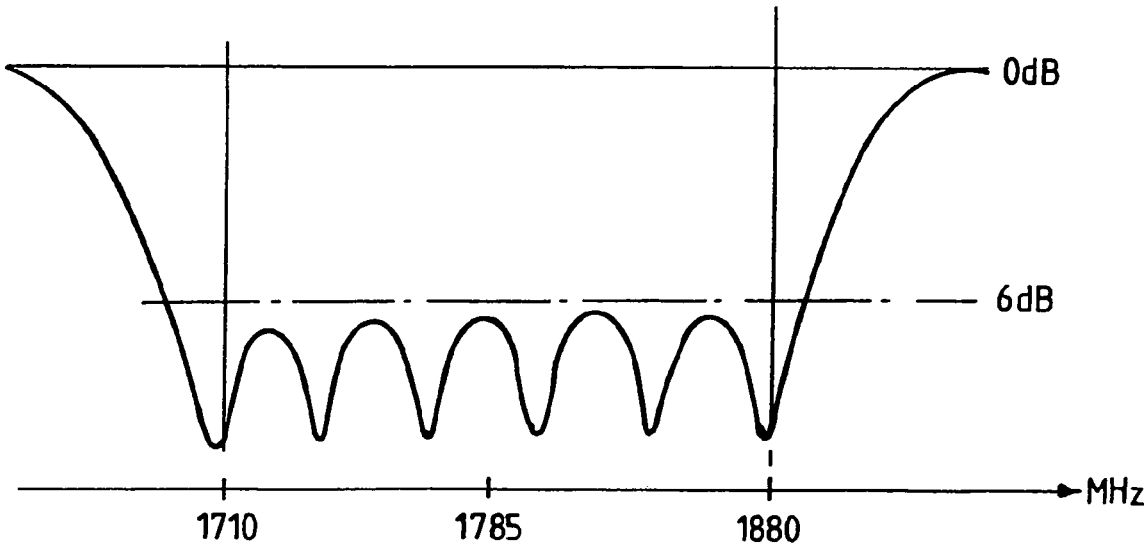
FIG. 7 is a graph indicating the resonances which may be obtained with an antenna of the kind shown in FIGS. 5A to 5C.

Referring to the diagram of FIG. 6, it will be seen that, in addition to the currents in the individual elements of each group, giving rise to correspondingly induced magnetic fields 30D, 30E, and 30F, the three-element structure offers shared current modes associated with currents common to respective pairs of elements (producing magnetic fields 30G and 30H) and currents common to all three elements (producing a magnetic field appearing in FIG. 6 as field 301). It follows that this antenna offers six fundamental balanced mode resonances which, with appropriate adjustment of the widths of the elements 10PE, 10PF, 10PG, 10QE, 10QF and 10QG and meandering of element edges, can be brought together as a collection of coupled resonances, as shown in FIG. 7. In this case, the antenna is configured to produce resonances forming an operating band corresponding to the GSM1800 band extending from 1710 to 1880 MHz.

Referring back to FIG. 5C, it will be seen that in this embodiment, the outer elements of each group have their outermost edges meandered. In practice, the inner edges of the outer elements 10PE, 10PG; 10QE, 10QG may also be meandered, but to a lesser amplitude than the meandering of the outer edges. The edges of the inner elements 10PF, 10QF are helical in this case.

While the bandwidth of an antenna can be increased using the techniques described above, some applications may require still greater bandwidth. For instance, the 3-G receive and transmit bands as specified by the IMT-2000 frequency allocation are neighbouring bands which, depending on the performance required, may not be covered by a single antenna. Since dielectrically-loaded antennas as described above are very small at the frequencies of the 3-G bands, it is possible to mount a plurality of such antennas in a single mobile telephone handset. The antennas described above are balanced mode antennas which, in use, are isolated from the handset ground. It is possible to employ a first antenna covering the transmit band and a second antenna covering the receive band, each having a filtering response (as shown in the graphs included in the drawings of the present application) to reject the other band. This allows the expensive diplexer filter of the conventional approach in this situation (i.e. a broadband antenna and a diplexer) to be dispensed with.

Figure 10:
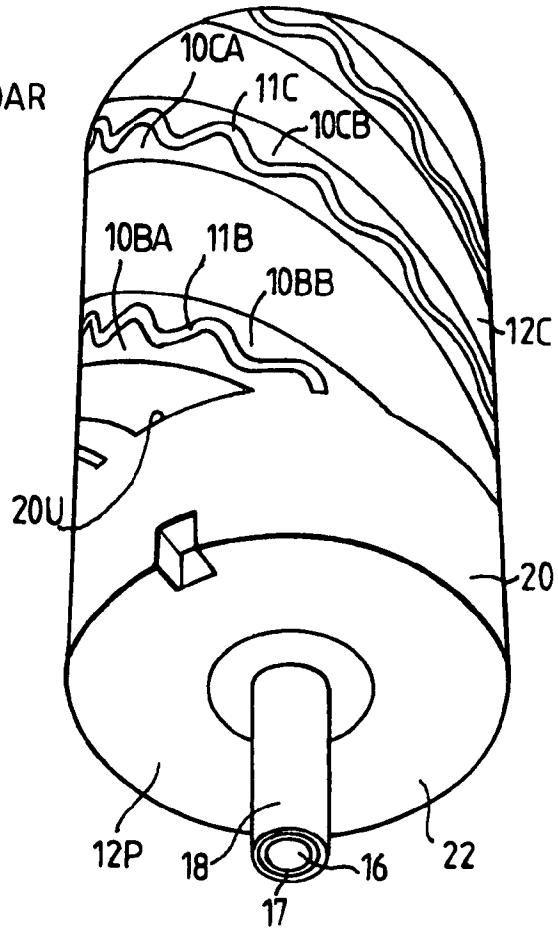
FIG. 10 is a third perspective view of the antenna of FIG. 1, viewed from below and from the side.
Figure 9:
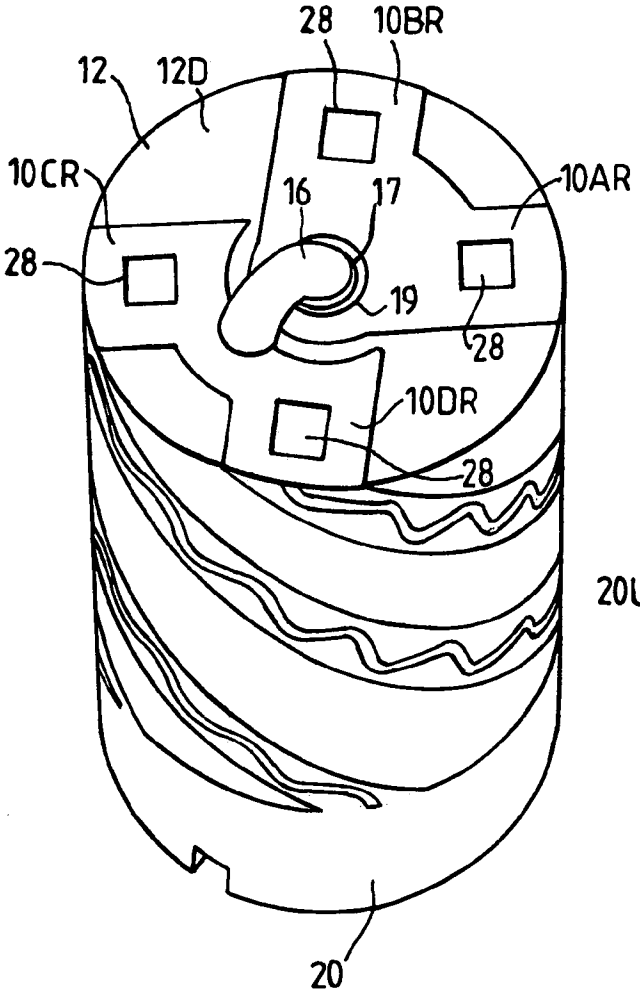
FIG. 9 is another perspective view of the antenna of FIG. 1, viewed mainly from the top.
Figure 8:
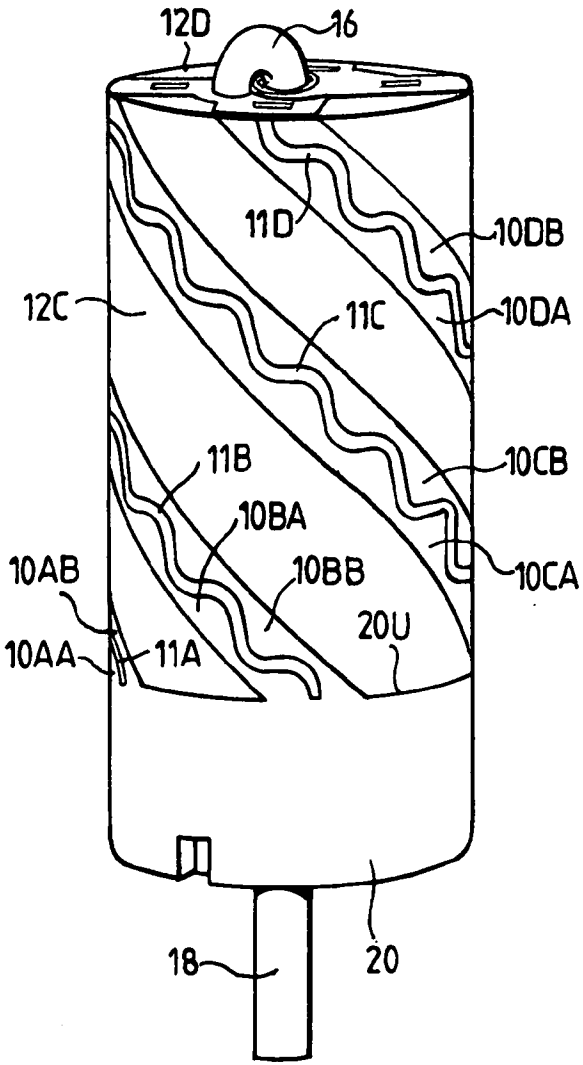
FIG. 8 is a perspective view of a dielectrically-loaded quadrifilar antenna in accordance with the invention, having four laterally opposed groups of elongate helical radiating conductors, viewed from the side.
Figure 11:
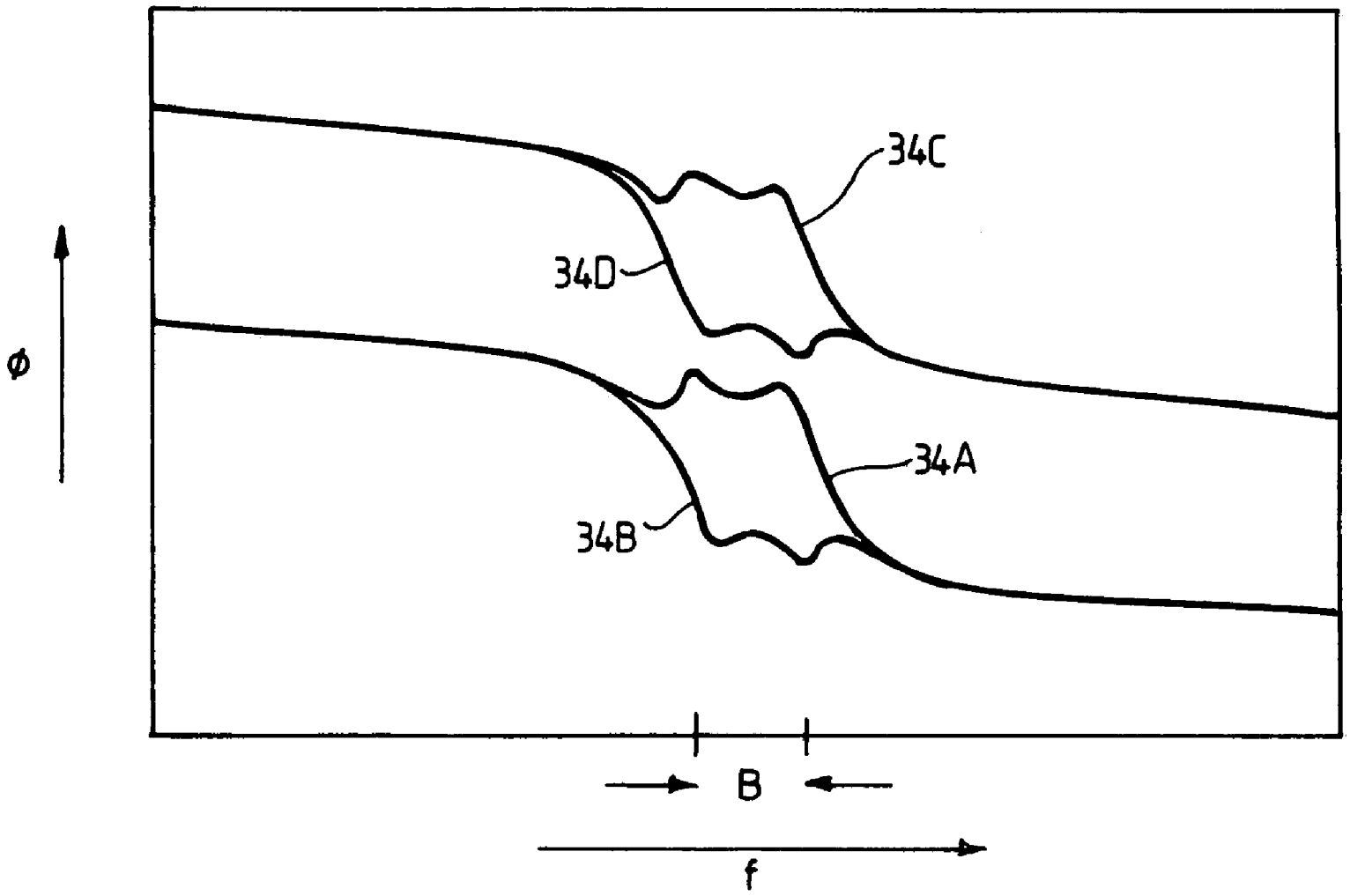
FIG. 11 is a diagram showing variations in current phase in the conductor groups of the antenna of FIGS. 8 to 10.

Referring now to FIGS. 8 to 10, a quadrifilar antenna in accordance with the invention has an antenna element structure with four longitudinally extending groups of radiating conductive tracks 10AA, 10AB, 10BA, 10BB, 10CA, 10CB, 10DA, 10DB which are formed on the cylindrical outer surface 12C of a solid ceramic core 12.

The core has an axial passage and the passage houses a coaxial feeder structure having an outer conductor 19, an inner dielectric insulating layer 17 and an inner conductor 16. The outer conductor 19 of the feeder structure may be spaced from the wall of the axial passage through the core 12 in which it is housed by a dielectric layer (not shown in the drawings) having a relative dielectric constant less than the relative dielectric constant of the material of the core. In particular, such a dielectric layer may consist of a plastics sheath as described and shown in the above-mentioned British Patent No. 2367429, the entire contents of which are incorporated in the present application by reference.

This coaxial feeder structure is for connecting radio communication apparatus (not shown) to the longitudinally extending track groups. The antenna element structure also includes four radial elements 10AR, 10BR, 10CR, 10DR formed as metallic tracks on a distal end face 12D of the core 12, connecting ends of the conductive tracks 10AA-10DB of the respective four longitudinally extending track groups to the feeder structure. The other ends of the conductive tracks 10AA-10DB are connected to a common virtual ground conductor 20 in the form of a plated sleeve surrounding a proximal end portion of the core 12. This sleeve 20 is, in turn, connected to the outer conductor 19 of the feeder structure in a manner described below. Two of the radial tracks 10CR, 10DR are connected at their inner ends to the inner conductor 16 of the feeder structure at the distal end of the core 12, and the other two radial tracks 10AR, 10BR are connected to the feeder screen formed by the outer conductor 19 of the feeder structure.

In this embodiment of the invention the four groups 10AA, 10AB-10DA, 10DB of conductive tracks 10AA-10DB are helical and have different lengths. Two of the groups 10BA, 10BB; 10DA, 10DB being longer than the other two 10AA, 10AB; 10CA, 10CB by virtue of extending nearer to the proximal end of the core 12. The elements of each pair of conductive track groups 10AA, 10AB, 10CA, 10CB; 10BA, 10BB, 10DA, 10DB are diametrically opposite each other on opposite sides of the core axis and each group of helical tracks 10AA-10DB follows a helical path centred on the axis of the cylindrical core. The difference in length between the two pairs of track groups in this embodiment results from the upper rim or linking edge 20U of the sleeve 20 being of varying height (i.e. varying distance from the proximal end face 12P of the core) to provide points of connection for the long and short track groups respectively. Thus, in this embodiment, the rim 20U follows a shallow zig-zag path around the core 12, the shorter track groups 10AA, 10AB; 10CA, 10CB meeting the rim 20U at points on the rim which are further from the proximal end face 12P than the points where the longer track groups 10BA, 10BB; 10DA, 10DB meet the rim 20U. The helical centre line of each of the track groups 10AA, 10AB-10DA, 10DB subtends substantially the same angle of rotation at the core axis, here in the region of about 180°, i.e. or half turn.

As described in, for instance, the above-mentioned British Patent No. 2310543, the differing lengths of the conductive paths constituted by the combinations of the radial tracks 10AR-10DR and helical track groups 10AA, 10AB-10DA, 10DB produce different transmission delays at a central operating frequency located between the resonant frequencies associated with the longer and shorter conductive paths, such that the antenna has a resonant mode for receiving or transmitting circularly polarised signals.

With the left-handed sense of the helical paths of the conductive track groups 10AA, 10AB-10DA, 10DB, the antenna has its highest gain for right-hand circularly polarised signals incident the antenna on the core axis and from above the distal end face 12D. If the antenna is to be used for left-hand circularly polarised signals, the direction of the helices is reversed and the pattern of connection of the radial elements is rotated through 90°. In the case of an antenna suitable for receiving both left-hand and right-hand circularly polarised signals, the conductive track groups can be arranged to follow paths which are generally parallel to the axis of the core.

The conductive sleeve 20 covers a proximal portion of the antenna core 12 and is proximally connected to the outer conductor 19 of the feeder structure by conductive plating 22 on the proximal end face 12P of the core 12. As described in the above-mentioned British Patent No. 2310543, the combination of the sleeve 20 and the plating 22 forms a balun so that signals on the transmission line formed by the feeder structure 16, 17, 19 are converted between an unbalanced state and the proximal end of the feeder structure and at at least approximately balanced state at the distal end. The disclosure of Patent No. 2310543 is incorporated in the present application by reference.

The combination of the sleeve 20 and proximal end face plating 22 also has the effect of isolating the rim 20U from the outer conductor 19 of the feeder structure at the operating frequencies of the antenna so that currents in the conductive track groups 10AA, 10AB-10DA, 10DB circulate between the inner and outer conductors 16, 19 of the feeder structure at its distal termination via conductive loops formed by respective pairs of the conductive track groups and portions of the sleeve rim 20U.

In practice, the conductive tracks in each group 10AA, 10AB-10DA, 10DB provide respective alternative conducting paths between the feed connection and the sleeve rim 20U. The tracks of each pair 10AA, 10AB-10DA, 10DB are separated by a respective channel or slit 11A, 11B, 11C, 11D extending from, firstly, a point at or very close to the connection of the track group to its respective radial element 10AR, 10BR, 10CR, 10DR to, secondly, the region where the tracks 10AA, 10AB-10DA, 10DB are connected to the sleeve rim 20U. More precisely, each channel 11A, 11B, 11C, 11D extends to the level of the rim 20U where it is connected to the respective tracks on each side of the channel. Preferably, however, the channel ends at a level just short of the level of the rim 20U at the respective track connections.

In this embodiment, the edges of the tracks 10AA-10DB which bound the respective channel 11A, 11B, 11C, 11D deviate from respective helical lines, e.g., by following respective meandering paths so that the channel 11A, 11B, 11C, 11D has a wave-like sinusoidal configuration with substantially parallel sides. In this way, the electrical length associated with each channel 11A, 11B, 11C, 11D is increased so as to be greater than the electrical lengths of the outwardly facing edges of the tracks of the corresponding track group 10AA, 10AB-10DA, 10DB. In practice, the electrical length associated with each channel approaches equivalence to a half wavelength at an operating frequency within the operating band of the antenna. The currents in the conductive paths on either side of the channel then develop a phase independence one from the other. This effect can be visualised by the analogy of two half-wave simple-harmonic resonances independently carried on respective tracks. According to the required electrical characteristics, including required bandwidth, the level of dissociation of the current flowing in the tracks of each pair 10AA, 10AB-10DA, 10DB produces a region of phase dwell in an otherwise linear phase-versus-frequency characteristic of the composite line formed by the pair of tracks. In effect, depending on the level of current dissociation, the band over which substantial phase orthogonality is achieved between currents in the shorter composite lines 10AA, 10AB; 10CA, 10CB and those in the longer composite lines 10BA, 10BB; 10DA, 10DB can be altered. This, in turn, affects the band over which the antenna is resonant in a mode associated with circularly-polarised radiation. Such phase dwell can be observed using a test arrangement such as that described and shown in the above-mentioned Patent No. 2356086. By bringing capacitive probes into juxtaposition with the lower ends of the composite lines, i.e. adjacent the sleeve rim 20U, the phases of the currents in the lines can be monitored as the antenna is supplied with a swept frequency signal from a generator coupled to the feed structure 16, 17, 18. The graph of FIG. 4 represents the phase-versus-frequency characteristics obtained from four probes in juxtaposition with the four composite lines. The antenna gain for circularly-polarised radiation incident along the axis of the antenna core 12 from the end having the feed connection towards the proximal end reaches a maximum when the two characteristics 30A, 30C for the shorter lines 10AA, 10AB; 10CA, 10CB exhibit about a 90° difference compared to the characteristics for the longer lines 10BA, 10BB; 10DA, 10DB respectively. As shown in FIG. 4, approximate phase orthogonality is achieved over a bandwidth B. In this embodiment B is approximately 16 MHz about a centre frequency of 1618 MHz.

The tracks of each track group 10AA, 10AB-10DA, 10DB may have differing average widths to yield different average electrical lengths within each group. However, it will be noted that a first track 10AA, 10BA, 10CA, 10DA of each track group meets the sleeve rim 20U with an acute included angle between them whereas, conversely, a second track 10AB, 10BB, 10CB, 10DB of each group meets the sleeve rim 20U with an obtuse included angle. These differences in the way in which the respective tracks meet the sleeve rim also cause small differences in the average electrical length of the tracks of each track pair. Consequently, even if the tracks of each pair have the same average width, there are two coupled resonances at slightly different frequencies associated with the longer track groups 10BA, 10BB; 10DA, 10DB and, similarly, there are two coupled resonances of different frequencies associated with the shorter track groups 10AA, 10AB; 10CA, 10CB.

The width of the channel is typically less than the average width of the tracks on each side. In general terms, the width of the channel is less than the spacing between adjacent groups of tracks 10AA, 10AB-10DA, 10DB, and preferably less than half of the spacing between the adjacent track groups. Each mutually adjacent pair of conductive tracks 10AA, 10AB-10DA, 10DB may be considered as forming part of a composite radiating helical antenna element.

By restricting the longitudinal extent of the channels 11A-11D so that at least part of each radial portion 10AR-10DR on the distal end face 12D of the core remains undivided, the radial portions can be reserved for forming cut-outs in the form of apertures 28 for trimming the antenna using, e.g., laser etching as described in the above-mentioned Patent No. 2356086.

In the above-described embodiment, the electrical lengths associated with the channels 11A-11D are increased compared with the average electrical lengths of the respective track groups 10AA, 10AB-10DA, 10DB by arranging for the edges of the tracks bounding the channels to be longer than the other edges of the tracks. In other words, each track inner edge deviates from a mean helical path whereas the outer edge of the respective track follows a simply helical path or deviates from such a path to a lesser degree than the deviation of the inner edge. In effect, the helical wave velocity associated with the channels 11A-11D is reduced by compared with the wave velocity associated with the outer edges of the tracks.

Such slowing of the wave velocity may be achieved in other ways. For instance, the physical lengths of the channels may be approximately be the same as the average helical length along the corresponding portion of the group of tracks but each channel may have, above, below, or within itself, an elongate dielectric element made of a material having a relative dielectric constant which is higher than the relative dielectric constant of the core 12. Thus, the core may be formed with integral higher-dielectric helical strips in registry with each channel or strips of a higher dielectric constant may be applied over or in each channel after the conductive tracks have been plated on the core 12 so that the average relative dielectric constant associated with the channel is higher than that associated with the outer edges of each track group.

What is claimed is:

1. A dielectrically-loaded antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a plurality of laterally opposed groups of conductive elongate elements, said groups being spaced apart on said core outer surface and each group comprising first and second substantially coextensive elongate elements which are coupled together at respective first ends at a location in the region of the feed connection and at respective second ends at a location spaced from the feed connection, wherein the antenna element structure further comprises a linking conductor linking the second ends of the first and second elongate elements of each of the plurality of groups of elements with the second ends of the first and second elements of the other of said plurality of groups of elements, whereby the first and second elements respectively of each of said plurality of groups form parts of different looped conductive paths, said paths having different respective resonant frequencies within an operating frequency band of the antenna and each extending from the feed connection to the linking conductor, and then back to the feed connection, and wherein at least one of the said elongate antenna elements comprises a conductive strip on the outer surface of the core, the strip having opposing edges of different lengths.

2. An antenna according to claim 1, wherein the or each said conductive strip has opposing edges of different lengths by virtue of the opposing edges being non-parallel.

3. An antenna according to claim 1, wherein that edge of the strip which is furthest from the other elongate element or elements in its group is longer than the edge which is nearer the other elongate element or elements of the group.

4. An antenna according to claim 3, wherein the longer edges are each meandered over the major part of their length.

5. An antenna according to claim 1, wherein each of said plurality of groups of elongate antenna elements has two mutually adjacent elements.

6. An antenna according to claim 5, wherein the elongate elements of each pair have different electrical lengths and define between them a parallel-sided channel, each element having a meandered edge.

7. An antenna according to claim 1, wherein that edge of the strip which is nearest to the other elongate element or elements in its group is longer than the edge which is further from the elongate element or elements of the group.

8. An antenna according to claim 1, wherein at least one of the edges of the or each said conductive strip is meandered.

9. An antenna according to claim 1, wherein the first and second elongate elements of each group have an edge which is an outermost edge of the group and both outermost edges are longer than the inner edges of the said elements of the group.

10. An antenna according to claim 9, wherein the said outermost edges of each group are substantially parallel to each other.

11. An antenna according to claim 1, wherein the first and second elements of each group are neighbouring elements and each has an inner edge which is longer than its outer edge.

12. An antenna according to claim 11, wherein said inner edges are substantially parallel to each other.

13. An antenna according to claim 1, wherein the said elongate antenna elements each extend from the feed connection to the linking conductor, and each has an electrical length in the region of a half wavelength at a frequency within the operating frequency band of the antenna.

14. An antenna according to claim 13, wherein the core is cylindrical and the feed connection comprises a feeder termination on an end face of the core, and wherein the major part of each said elongate antenna element comprises a helical conductor which executes a half turn around the core centred on the core axis, and wherein the linking conductor comprises an annular conductor around the core centred on the axis.

15. An antenna according to claim 14, including an axial feeder structure extending through the core from the feeder connection on a first end face of the core to a second end face of the core, and wherein the linking conductor comprises a conductive sleeve connecting the said second ends of the elongate elements to the feeder structure at a position spaced from the said feeder connection.

16. An antenna according to claim 1, having a fractional bandwidth of at least 3% at an insertion loss of −6 dB.

17. A dielectrically-loaded antenna for operation at frequencies in excess of 200 MHz, comprising an electrically insulative core of a solid dielectric material having a relative dielectric constant greater than 5, a feed connection, and an antenna element structure disposed on or adjacent the outer surface of the core, wherein the core has end surfaces and side surfaces and an axis of symmetry passing through the end surfaces, and wherein the antenna element structure comprises a plurality of groups of elongate antenna elements spaced apart on said side surfaces of the core, each group forming part of a plurality of looped conductive paths which extend from a first terminal to a second terminal of the feed connection and which have different electrical lengths at a frequency within an operating band of the antenna, and each group comprising first and second substantially coextensive elongate radiating elements which run side-by-side on or adjacent the side surfaces of the core and which form part of a different respective one of said looped paths of differentelectrical lengths, wherein at least one of the said elongate elements on or adjacent the side surfaces comprises a conductive strip having non-parallel opposing edges such that the opposing edges of strip are of different lengths.

18. An antenna according to claim 17, wherein the feed connection is located on one of the end surfaces of the core and the said elongate elements of the group are connected to the feed connection by a plurality of connecting elements on or adjacent the said end surface.

19. An antenna according to claim 17, wherein the strip has non-parallel edges over at least the major part of its length on the respective side surface or surfaces of the core.

20. A dielectrically loaded antenna for operation at frequencies in excess of 200 MHz, comprising an electrically insulative core of a solid material having a relative dielectric constant greater than 5, a feed connection having a plurality of feed nodes, and an antenna element structure disposed on or adjacent the outer surface of the core, the material of the core occupying the major part of the volume defined by the core outer surface, wherein the antenna element structure comprises a plurality of groups of conductive elongate elements, each group comprising first and second substantially coextensive mutually adjacent elongate elements that are both connected to a common said feed node, at least one of which elements comprises a conductive strip on the outer surface of the core, the strip having opposing edges of different lengths.

21. An antenna according to claim 20, wherein the or each said conductive strip has opposing edges of different lengths by virtue of the opposing edges being non-parallel.

22. An antenna according to claim 20, wherein at least one of the edges of the or each said conductive strip is meandered.

23. An antenna according to claim 20, wherein each said group of conductive elongate elements has a pair of mutually adjacent elements which define between them a substantially parallel-sided channel.

24. An antenna according to claim 23, wherein each of the elements of said pair comprises a conductive helical track at least one edge of which is meandered.

25. An antenna according to claim 20, further comprising a linking conductor, said groups of conductive elongate elements extending helically between the feed connection and the linking conductor.

26. An antenna according to claim 20, wherein:

the core is cylindrical and has a central axis;

the feed connection comprises a feeder termination on an end face of the core, the antenna element structure includes a linking conductor in the form of an annular conductor encircling the core and centred on the axis, and the groups of conductive elongate elements each comprise a plurality of conductive tracks on the outer surface of the core and extending between the feed connection and the linking conductor, each track being helical in form and each executing a half turn around the core centred on said axis.

27. An antenna according to claim 26, wherein each said group of conductive elongate elements has a pair of mutually adjacent conductive tracks which define between them a substantially parallel-sided channel extending substantially to the linking conductor.

28. An antenna according to claim 27, including an axial feeder structure extending through the core from the feeder connection on a first end face of the core to a second end face of the core, and wherein the linking conductor comprises a conductive sleeve which interconnects said conductive tracks at ends thereof opposite to said feed connection and which is connected to the feeder structure at a position spaced from said feed connection.

29. An antenna according to claim 20, wherein said first and second coextensive elongate elements comprise, respectively, a first conductive track having a first average width and a second conductive track having a second average width, the second average width being different from the first average width.

30. An antenna according to claim 20, wherein said first and second coextensive elongate elements comprise, respectively, a first conductive track having a first electrical length and a second conductive track having a second electrical length which is different from the first electrical length.

31. An antenna according to claim 20, having four said groups of conductive elongate elements.

32. An antenna according to claim 20, wherein said first and second coextensive elongate elements comprise, respectively, first and second coextensive conductive tracks defining between them a channel the width of which is less than the spacing between the tracks of the respective said groups and the tracks of neighbouring groups, and wherein the electrical length of the channel is substantially a half wavelength in an operative frequency hand of the antenna.

33. A quadrifilar helical antenna for operation in a frequency band above 200 MHz, wherein the antenna comprises four coextensive composite helical antenna elements each of which is formed as the combination of first and second coextensive elongate conductors separated by a slit, the width of the slit being less than half of the spacing between the respective composite element and either of the neighbouring composite elements, wherein each of said first and second conductors has an inner edge portion bounding the slit and an oppositely directed outer edge portion which does not bound the slit, and, wherein the slit and said inner edge portions of said first and second coextensive conductors define elongate boundary regions which at a frequency within the operating band of the antenna have an associated electrical length which is greater than the electrical length of said outer edge portions of said first and second coextensive conductors.

34. An antenna according to claim 33, wherein said coextensive conductors of each composite element are electrically linked together at or adjacent a common feed connection.

35. An antenna according to claim 33, wherein the slit and said edge portions of the said coextensive conductors bounding the slit define elongate boundary regions having an electrical length which is substantially $n②_g/2$ where n is an integer (1, 2, 3, . . . ) and $②_g$ is the guide wavelength in the boundary regions at a frequency within the operating band of the antenna.

36. An antenna according to claim 33, comprising an antenna substrate and a feed connection, wherein said first and second coextensive elongate conductors are located on an outer surface of the substrate and have first and second ends, the first ends being connected together and to the feed connection and the second ends being connected together on or adjacent the said outer surface.

37. An antenna according to claim 33, wherein said first and second coextensive elongate conductors are coextensive over the whole of their respective lengths.

38. An antenna according to claim 33, comprising a cylindrical core made of a solid dielectric material having a relative dielectric constant greater than 5, a feed connection associated with one end of the core, and a linking conductor associated with the other end of the core, wherein each of the composite helical antenna elements comprises a pair of co-extensive elongate conductive tracks on the cylindrical outer surface of the core having respective first and second ends, the first ends of the tracks being connected together and to the feed connection and the seconds ends are connected to the linking conductor, the linking conductor interconnecting all four composite helical antenna elements.

39. An antenna according to claim 33, wherein the slit is meandered.

40. An antenna according to claim 33, including a plurality of elongate dielectric elements each associated with a respective said slit and having a higher relative dielectric constant than the relative dielectric constant of the electrically insulative surroundings of the composite antenna elements.

41. An antenna according to claim 33, wherein said first and second coextensive elongate conductors comprise conductive tracks formed on a dielectric substrate having a first relative dielectric constant, and wherein the slit is occupied by a material having a second relative dielectric constant which is higher than the first relative dielectric constant.

* * * * *